US009388992B2

(12) United States Patent
Wie et al.

(10) Patent No.: US 9,388,992 B2
(45) Date of Patent: Jul. 12, 2016

(54) GAS OVEN RANGE

(71) Applicant: LG ELECTRONICS INC., Seoul (KR)

(72) Inventors: Jeahyuk Wie, Changwon-si (KR); Youngsoo Kim, Changwon-si (KR); Yangho Kim, Changwon-si (KR); Ingyu Yang, Changwon-si (KR)

(73) Assignee: LG ELECTRONICS INC., Seoul (KR)

( * ) Notice: Subject to any disclaimer, the term of this patent is extended or adjusted under 35 U.S.C. 154(b) by 358 days.

(21) Appl. No.: 14/086,397

(22) Filed: Nov. 21, 2013

(65) Prior Publication Data

US 2014/0144422 A1 May 29, 2014

(30) Foreign Application Priority Data

Nov. 27, 2012 (KR) ..... 10-2012-0135400

(51) Int. Cl.
*F24C 3/08* (2006.01)
*F24C 15/32* (2006.01)

(52) U.S. Cl.
CPC ..... *F24C 15/322* (2013.01); *F24C 3/087* (2013.01)

(58) Field of Classification Search
CPC ..... F24C 3/087
USPC ..... 126/21 A, 39 E
See application file for complete search history.

(56) References Cited

U.S. PATENT DOCUMENTS 2,288,937 A * 7/1942 Chambers ..... G05D 23/128 126/39 C
3,698,377 A * 10/1972 Smith ..... F24C 15/322 126/21 A
7,468,495 B2 * 12/2008 Carbone ..... F24C 15/325 126/21 A

FOREIGN PATENT DOCUMENTS

JP 10-038280 A 2/1998
JP 10-332150 12/1998
JP 4439304 1/2010
KR 10-0889132 B1 3/2009

OTHER PUBLICATIONS

Korean Notice of Allowance dated Nov. 20, 2014.
Korean Office Action dated Jan. 27, 2014 issued in Application No. KR 10-2012-0135400.

* cited by examiner

*Primary Examiner* — Avinash Savani
(74) *Attorney, Agent, or Firm* — KED & Associates LLP

(57) ABSTRACT

A gas oven range may include a cavity forming a cooking chamber in which food may be cooked and a burner assembly installed on a rear wall of the cavity to heat the cavity. The burner assembly may include a burner having flame holes formed therein, a plate supporting the burner, and a cover covering the burner to form a burner chamber. An inlet may guide air from the cooking chamber into the burner chamber, and a partition may be provided between the cover and the plate to partition air flowing from the cooking chamber into the burner chamber from flames generated by the burner.

16 Claims, 7 Drawing Sheets

GAS OVEN RANGE

CROSS-REFERENCE TO RELATED APPLICATION(S)

This application claims priority under 35 U.S.C. §119 to Korean Application No. 10-2012-0135400, filed in Korea on Nov. 27, 2012, whose entire disclosure is hereby incorporated by reference.

BACKGROUND

1. Field

This relates to a gas powered cooking appliance.

2. Background

A gas oven range is a cooking appliance that cooks food using gas. Such a gas oven range may include a cooking chamber in which the food is cooked, and a burner that burns the gas for heating the cooking chamber. A burner chamber may be provided below a bottom surface of the cooking chamber, with a burner for convectively heating the cooking chamber installed in the burner chamber.

BRIEF DESCRIPTION OF THE DRAWINGS

The embodiments will be described in detail with reference to the following drawings in which like reference numerals refer to like elements wherein.

DETAILED DESCRIPTION

Reference will now be made in detail to various embodiments, examples of which are illustrated in the accompanying drawings.

In the following detailed description, reference is made to the accompanying drawings that form a part hereof, and in which is shown by way of illustration various embodiments. These embodiments are described in sufficient detail to enable those skilled in the art, and it is understood that other embodiments may be utilized and that logical structural, mechanical, electrical, and chemical changes may be made without departing from the spirit or scope as broadly described herein. To avoid detail not necessary to enable those skilled in the art, the description may omit certain information known to those skilled in the art. The following detailed description is, therefore, not to be taken in a limiting sense.

In a gas oven range, a burner chamber housing a gas burner may be provided below a cooking chamber in which items are received for cooking. The cooking chamber and the burner chamber may communicate with each other through openings in the bottom surface of the cooking chamber in order to transfer air heated by the burner from the burner chamber to the cooking chamber. While these openings may provide for effective transfer of heat from the burner chamber to the cooking chamber, food and other matter may flow into the burner chamber through the openings while the food is cooked in the cooking chamber and/or received into and/or removed from the cooking chamber, causing possible contamination and malfunction of the burner. These openings in the bottom surface of the cooking chamber may also make it difficult to clean the cooking chamber. Further, installation of the burner below the cooking chamber may detract from capacity of the cooking chamber.

Figure 1A:
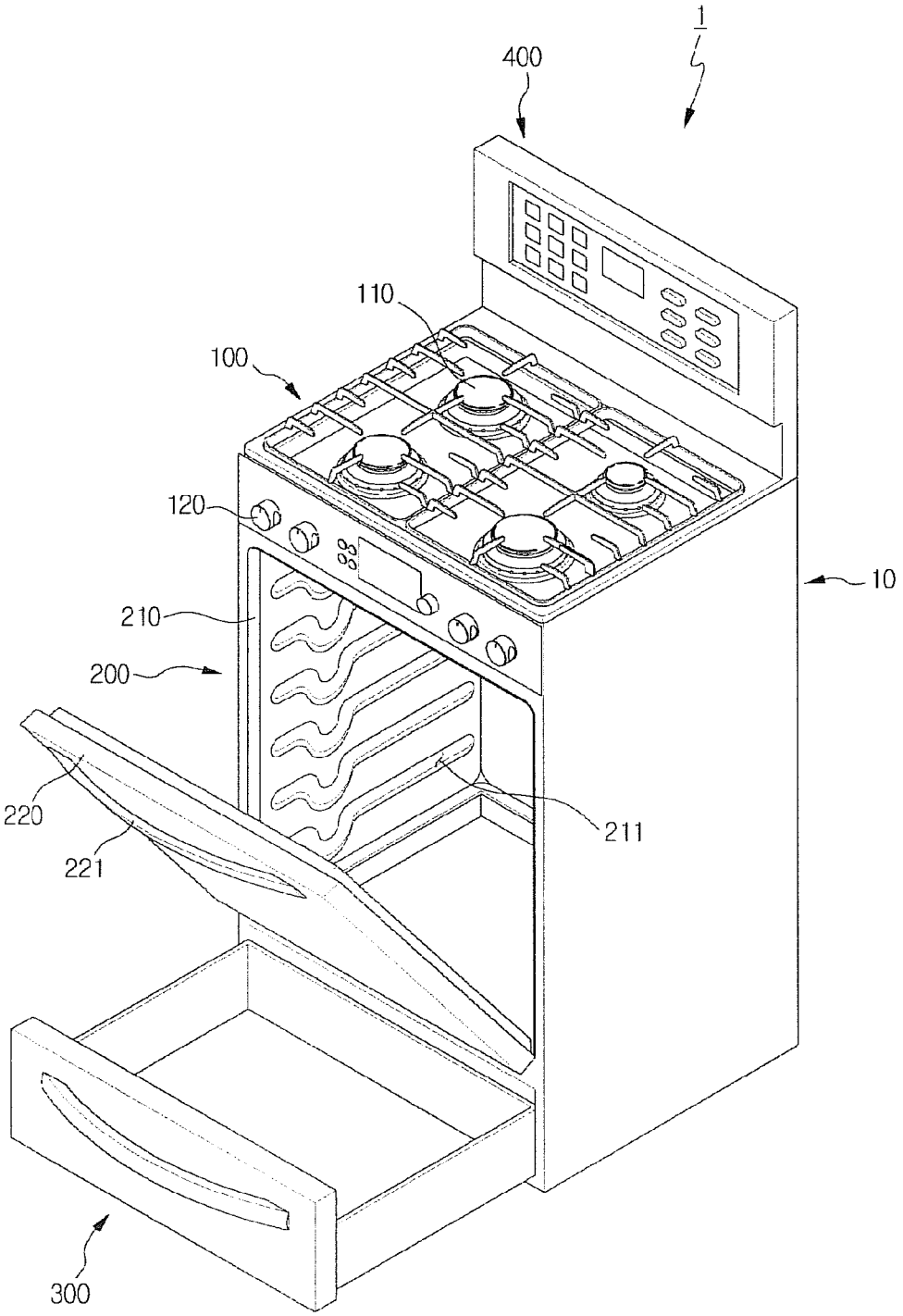
FIGS. 1A and 1B are perspective views of exemplary gas oven ranges, according to embodiments as broadly described herein.
Figure 1B:
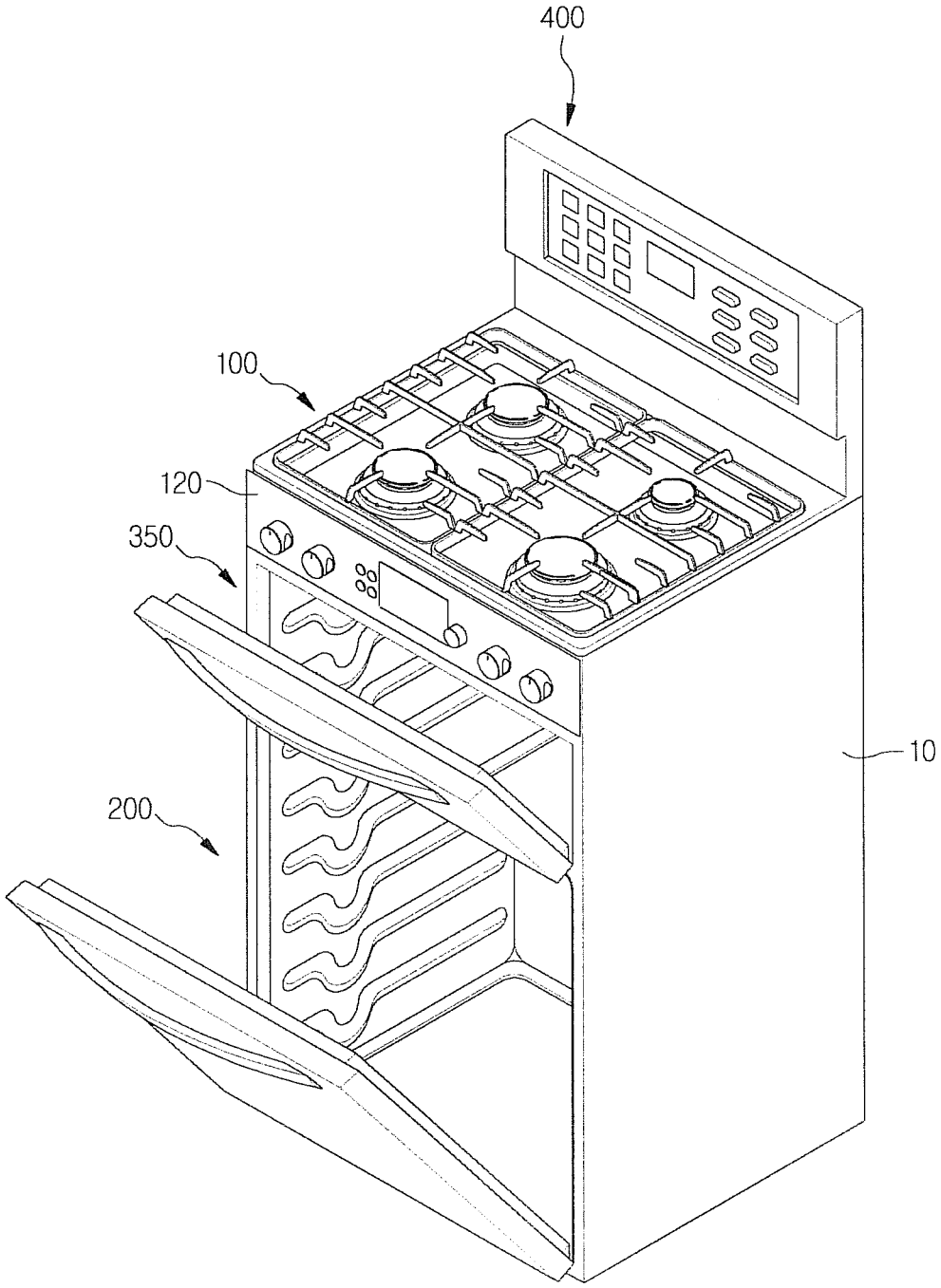
Figure 2:
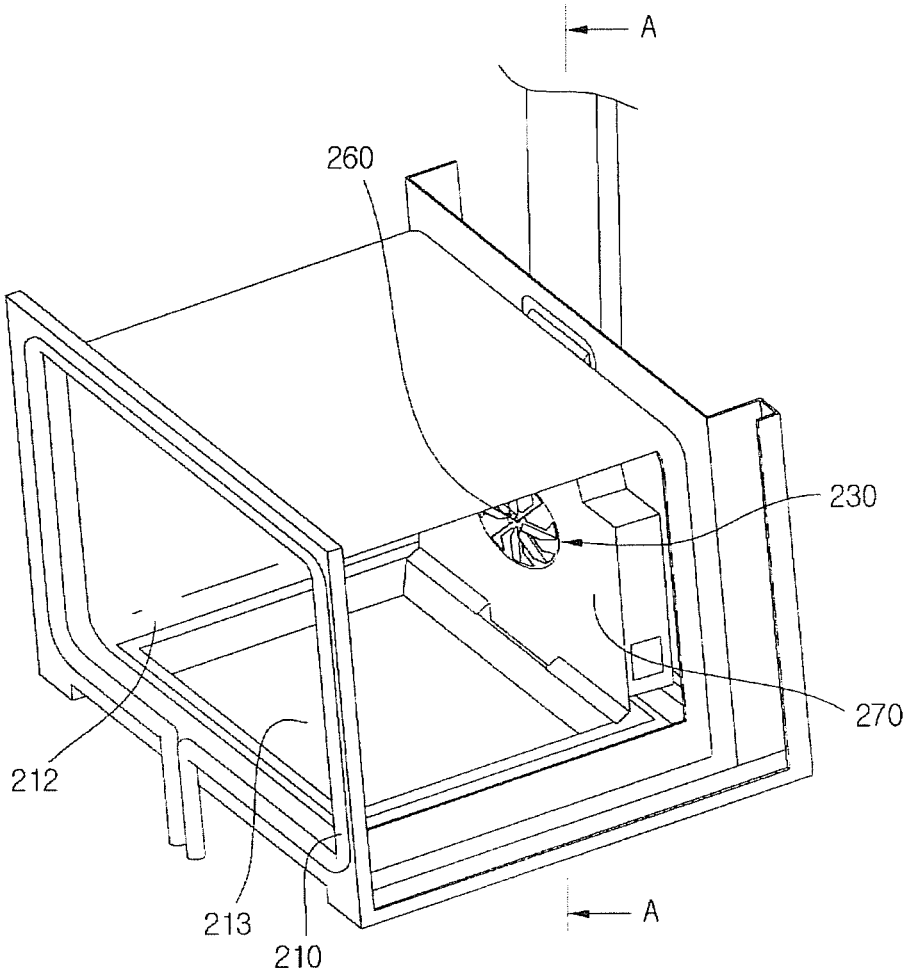
FIG. 2 is a perspective view of a cooking chamber of an oven shown in FIGS. 1A and 1B.

Referring to FIGS. 1A and 1B, a gas oven range 1, in accordance with embodiments as broadly described herein, may include a main body 10, a cooktop 100, a main oven 200, and a controller 400. As shown in FIG. 1A, a drawer 300 may be slidably coupled to the main body 10. As shown in FIG. 1B, an auxiliary oven 350 may be provided above the main oven 200. In certain embodiments, the cooktop 100 and/or the drawer part 300 may be omitted, depending on a type and installation. The cooktop 100, the oven 200, and the drawer 300 may be arranged may be at an upper part, a central part, and a lower part of the main body 10, respectively, as in the exemplary embodiment shown in FIG. 1A. Similarly, the cooktop 100, the main oven 200 and the auxiliary oven 350 may be arranged as shown in FIG. 1B, or other arrangement as appropriate. The controller 400 may be provided, for example, at a rear end of an upper surface of the main body 10, or other location as appropriate.

The cooktop 100 may include a plurality of cooktop burners 110 to directly heat containers in which food is received, using flames generated by burning gas. A plurality of knobs 120 may be provided at a front end of the cooktop 100 to open or close a valve controlling a supply of gas to a particular burner 110, or a supply amount, or an opening degree of the valve.

The oven 200 may include a cavity 210 forming a cooking chamber 211. The cavity 210 may include two opposite lateral side walls, an upper wall, a rear wall, and a bottom wall, with the front surface of the cavity 210 open. The oven 200 may also include an oven door 220 opening and closing the cooking chamber 211. The oven door 220 may be rotatably connected to the main body 10. For example, the oven door 220 may open and close the cooking chamber 211 by a pull-down method in which an upper end vertically pivots about the lower end thereof. However, an operating method of the oven door 220 is not limited to this. A door handle 221 to be grasped by a user may be provided at an upper front end of the oven door 220 in order to facilitate rotation of the oven door 220.

The drawer 300 may keep a container, in which food is received, warm at a predetermined temperature. The drawer 300 may be slidably received in the main body 10. The auxiliary oven 350 may be capable of being rapidly heated to a desired temperature, and may be suitable for broiling.

The controller 400 may receive an operating signal for operating the gas oven range 1, for example, an operating signal for operating at least one of the cooktop 100, and/or the oven 200, and/or the drawer 300, and/or the auxiliary oven 350. The controller 400 may also externally display various information related to the operation of the gas oven range 1.

Referring to FIGS. 2 to 6, a burner assembly 230 for generating heat to be provided to the cooking chamber 211 may be provided on the rear wall 216 of the cavity 210. The burner assembly 230 may be coupled with the rear wall 216 of the cavity 210 in the cooking chamber 211.

A recessed portion 213 for increasing a capacity of the cavity 210 may be formed in the bottom wall 212 of the cavity 210, as a part of the bottom wall 212 that is recessed downward. That is, in this embodiment, since the burner assembly 230 is installed at the rear wall 216 of the cavity 210, and not below the cavity 210, the recessed portion 213 may be formed at the bottom wall of the cavity 210 to increase the capacity of the cavity 210.

The burner assembly 230 may include a burner 240 which may generate flames by burning gas, a plate 250 supporting the burner 240, a fan 260 for blowing air heated by the flames into the cooking chamber 211, a cover 270 covering the burner 240, and a fan motor 280 for rotating the fan 260. A discharge port 290 for discharging the burned gas may be provided at the rear wall 216 of the cavity 210.

Figure 3:
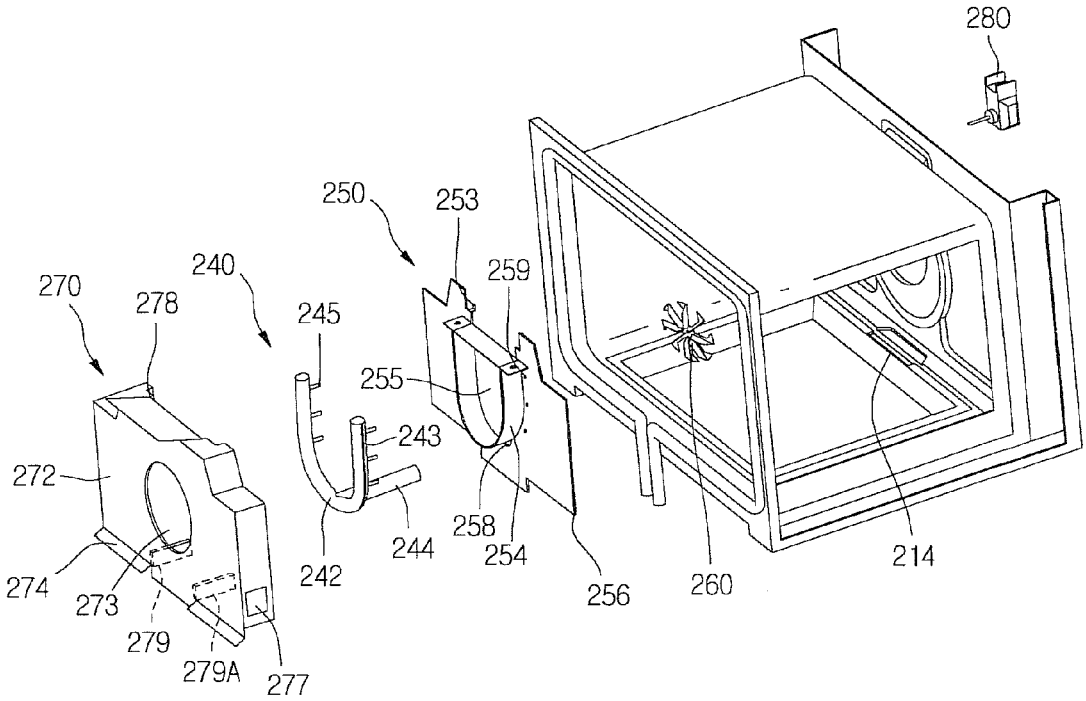
FIG. 3 is an exploded perspective view of a burner assembly of the oven shown in FIG. 2, according to an embodiment as broadly described herein.
Figure 4:
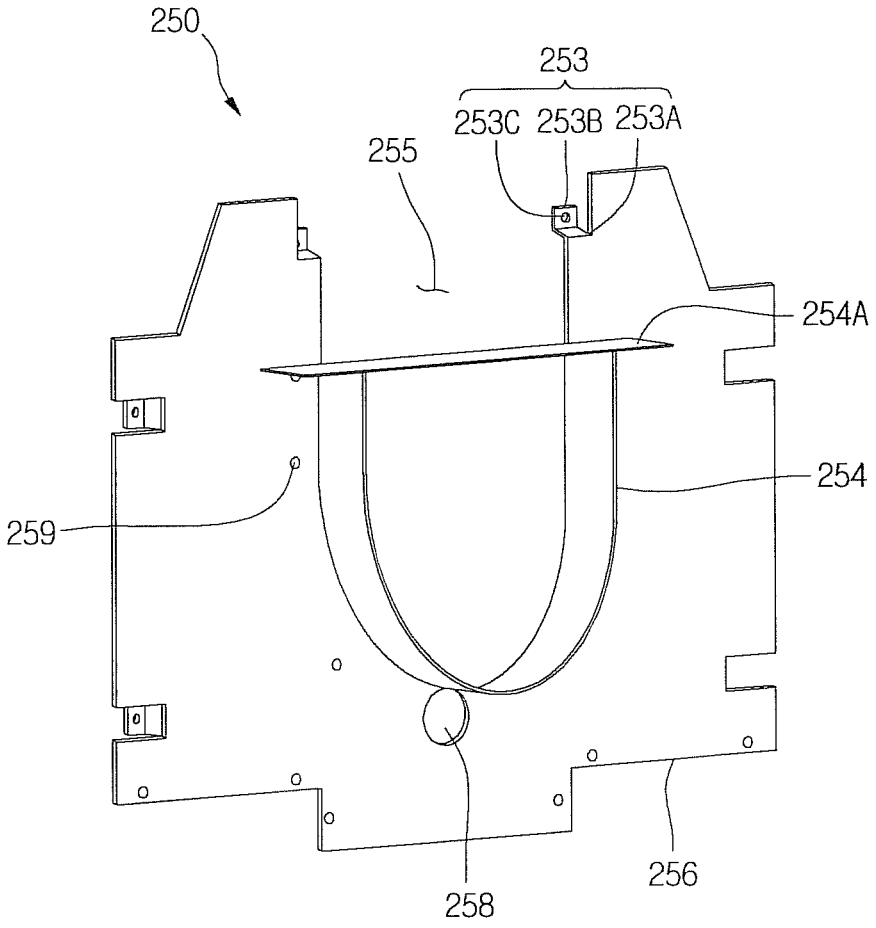
FIG. 4 is a perspective view of a plate of the burner assembly shown in FIG. 3.
Figure 6:
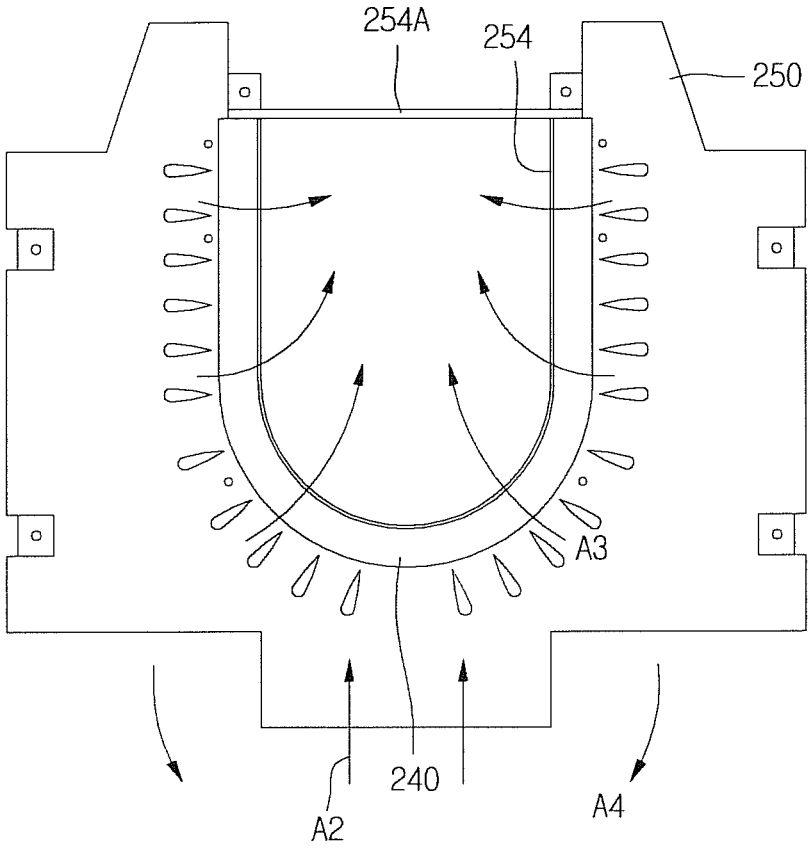
FIG. 6 illustrates a flame pattern generated by the burner installed on the plate, in accordance with an embodiment as broadly described herein.

The burner 240 may include a burner body 242, and a supply duct or pipe 244 supplying a gas and air mixture to the burner body 242. The burner body 242 may be somewhat rounded to increase a flame generation area. For example, the burner body 242 may have a "U"-like shape, as shown in FIGS. 3 and 6. However, the burner body 242 may have various other shapes as appropriate, such as, for example, circular, elliptical and the like. One or more protrusions 245 for penetrating the plate 250 may be formed at the burner body 242.

The supply duct 244 may be connected to a lower portion of the burner body 242. For example, the supply duct 244 may be connected to a curved portion of the burner body 242. The mixed gas supplied from the supply duct 244 may be divided and flow to the two opposite sides of the burner body 242. In this embodiment, the mixed gas is divided to flow into the burner body 242 so that flames may be evenly generated throughout the burner body 242. The supply duct 244 may penetrate the rear wall 216 of the cavity 210 and extend to a rear side of the rear wall 216. In addition, a nozzle may be disposed at a position aligned with the supply duct 244.

An opening 255 may be formed at a central portion of the plate 250 to allow air to flow therethrough. In addition, a first hole 258 may be formed below the opening 255, to allow the supply duct 244 to pass through the first hole 258, such that the burner 240 may be primarily supported on the plate 250. The positioning of the supply duct 244 through the first hole 258 may prevent the burner 240 from moving in a vertical direction. One or more second holes 259 through which the one or more protrusions 245 of the burner body 242 pass may be formed in the plate 250 to prevent the burner 240 from moving in a horizontal direction and rotating.

A first partition 254 for guiding air flow and partitioning, or isolating, the flames generated by the burner 240 from the air flow, may be formed at the plate 250, adjacent to the opening 255. The first partition 254 may be disposed to face the burner body 242 and be formed in substantially the same shape as the burner body 242. The first partition 254 may protrude toward the cover 270 from the plate 250. That is, the first partition 254 may protrude from the plate 250 in a direction away from the rear wall 216 of the cavity 210. The burner body 242 may be positioned outside the first partition 254 while installed on the plate 250, such that the burner body 242 covers the outside of the first partition 254. In this case, the burner body 242 may be in contact with or separated from an outer surface of the first partition 254.

A second partition 254A may be provided at an upper end of the first partition 254. The second partition 254A may connect the two upper ends of the first partition 254, and may partition the air flow from the flames of the burner 240. Rotation of the fan 260 causes air in the cooking chamber 211 to pass through a region where the first partition 254 and the second partition 254A surround the opening 255 and guide the air through the opening 255. In this case, the partitions 254 and 254A may partition the air flow and the flames and guide the air flow.

The burner body 242 may have a hollow cylindrical shape, and a plurality of flame holes 243 may be formed at an outer peripheral surface (a surface of the burner body 242 having a relatively large length) of the burner body 242. In this embodiment, an inner peripheral surface of the burner body 242 may face the first partition 254, with the outer peripheral surface of the burner body 242 being opposite the inner peripheral surface. In this embodiment, the plurality of flame holes 243 may be formed on the outer peripheral surface of the burner body 242 to avoid interference of flames generated by adjacent flame holes 243.

In this embodiment, since the air flow and the flames are partitioned, or isolated, by the partitions 254 and 254A, a flame blowing phenomenon (flame instability) due to the air flow may be prevented, and air at a periphery of the burner 240 may be rapidly heated up to a target temperature.

Alternatively, the partitions 254 and 254A may also be formed at the cover 270, and may extend backward toward the plate 250 from the cover 270.

One or more fastening portions 253 for fixing the plate 250 to the rear wall 216 of the cavity 210 may be formed at the plate 250. The fastening portions 253 may protrude toward the rear wall 216 of the cavity 210 from the plate 250. The fastening portions 253 may include a first extension 253A extending horizontally from the plate 250, and a second extension 253B extending vertically from an end of the first extension 253A. A fastening hole 253C may be formed in the second extension 253B.

When the fastening portions 253 of the plate 250 are fastened to the rear wall 216 of the cavity 210, the plate 250 and the rear wall 216 of the cavity 210 may be spaced apart from each other, and an air passage P in which the heated air flows may be formed between the plate 250 and the rear wall 216. The fan 260 may be positioned in the air passage P.

One or more communicating openings 256 through which the heated air flows may be formed at two opposite lower ends of the plate 250. Accordingly, the air from the air passage P may pass through the communicating openings 256 due to rotation of the fan 260 and flow forward. In FIG. 3, as an example, two communicating openings 256 are formed, but the number of communicating openings is not limited, and various numbers and/or arrangements of openings may be appropriate.

While the plate 250 is installed on the rear wall 216 of the cavity 210, a lower central portion of the plate 250 (a portion between the two communicating holes 256) may be in contact with the bottom wall 212 of the cavity 210.

The cover 270 may cover the burner 240 at the front of the plate 250. The cover 270 may include a cover body 272. The burner 240 may be positioned between the cover body 272 and the plate 250. The cover 270 may be coupled with the rear wall 216 of the cavity 210. The cover 270 may define a burner chamber C together with the plate 250, and a part of the bottom wall 212 of the cavity 210.

The cover 270 may include one or more inlets 273 to guide air from the cooking chamber 211 into the burner chamber C, and one or more outlets for discharging the air heated by the burner 240 to the cooking chamber 211.

For example, the inlets 273 may be formed at a central portion of the cover body 272. The outlets may include at least one side outlet 277, at least one upper outlet 278, and at least one lower outlet 279. A contact portion 275 of the cover 270 contacting the bottom wall 212 of the cavity 210 may be provided at the lower central portion of the cover member 270. A part of the cover 270 may be cut and curved forward to form discharge guides 274 at the two ends of the contact portion 275. The cut portion(s) forming the discharge guide (s) 274 may define the lower outlet(s) 279. The discharge guide 274 may be inclined downward toward the front (a direction facing the oven door 270) from the cover 270, as shown in FIG. 3. The discharge guide 274 may face the communicating opening 256 formed in the plate 250.

Accordingly, the air passing through the communicating opening 256 passes through the lower outlet 279 and then flows toward the oven door 220, guided by the discharge guide 274. That is, the air discharged through the lower outlet 279 by the discharge guide 274 does not directly flow toward the inlet 273, but may flow toward the oven door 220 to thereby fully and uniformly heat the cooking chamber 211.

Figure 5:
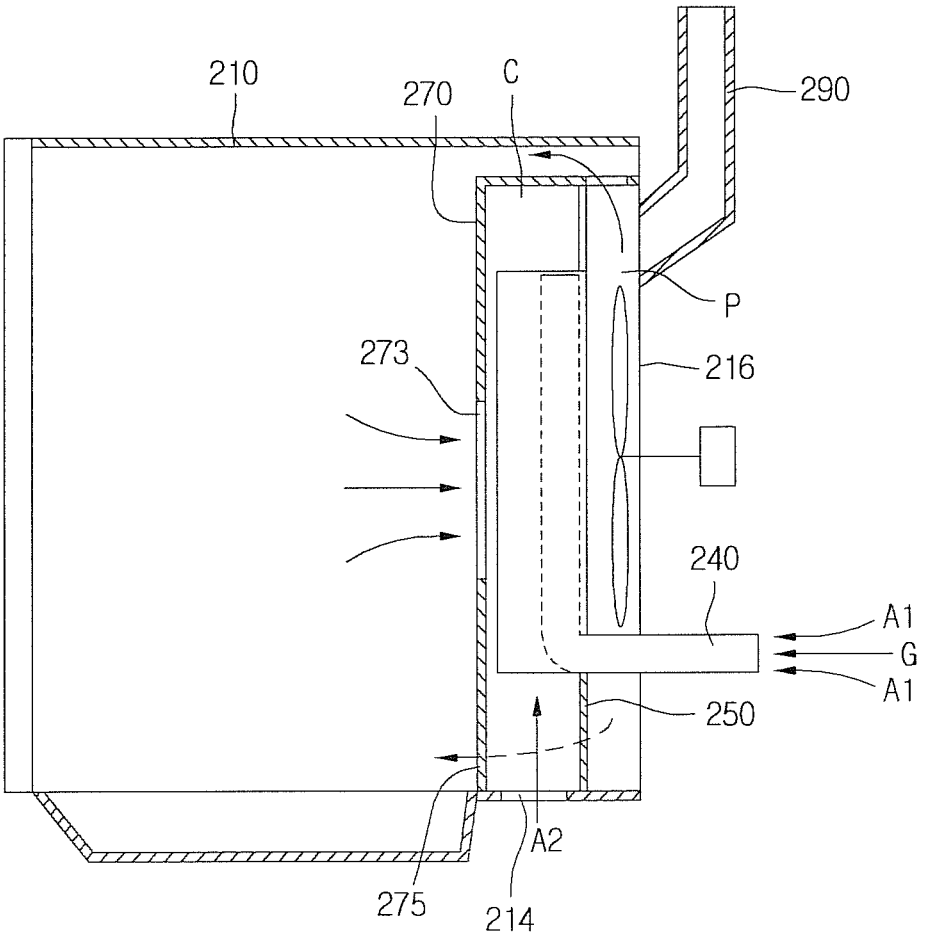
FIG. 5 is a cross-sectional view taken along line A-A of FIG. 2.

Referring to FIG. 5, when gas G is injected from the nozzle into the supply duct 244 at high speed, external air A1 (air from outside the cavity 210) near the supply duct 244 is supplied to the supply duct 244 together with the gas G. In this case, the external air A1 is supplied to the supply duct 244 due to a pressure difference when a peripheral portion of the gas G supplied to the supply duct 244 is at low pressure.

Accordingly, when the air is supplied to the supply duct 244 in this manner, air required for burning the mixed gas may not sufficiently be supplied to the burner body 242. In this case, an incomplete burning phenomenon of the mixed gas may occur, and as a result, an increased amount of carbon monoxide may be generated due to the incomplete burning.

Accordingly, in this embodiment, in order to prevent the incomplete burning phenomenon, an air inlet 214 to which additional air A2 for burning the mixed gas flows may be formed in the bottom wall 212 of the cavity 210. The air inlet 214 may be provided in a region of the bottom wall 212 corresponding to a region between the contact portion 275 and the lower central portion of the plate 250 defining the burner chamber C. Accordingly, the air passing through the air inlet 214 may flow between the contact portion 275 of the cover 270 and the lower central portion of the plate 250, and then toward the burner 240.

In this embodiment, in order to prevent the air A2 flowing through the air inlet 214 from being mixed with the air in the cooking chamber 211, the cover 270 and the plate 250 may contact a wall (for example, the bottom wall 212) with the air inlet 214. That is, in this embodiment, the contact portion 275 of the cover 270 and the lower central portion of the plate 250 may contact the bottom wall 212 having the air inlet 214 formed therein.

Alternatively, the air inlet 214 may be formed in one or both of the side walls of the cavity 210.

Further, in order to prevent the air A2 flowing through the air inlet 214 from being influenced by air A4 discharged through the communicating opening(s) 256 of the plate 250, a partition 279A for partitioning the flowing air A2 and the discharged air A4 may be formed at the cover 270 or the plate 250. That is, the partition 279A may be provided between the cover 270 and the plate 250.

In embodiments as broadly described herein, for example, the partition 279A is formed at the cover 270 and extends back toward the rear wall 216 of the cavity 210. Alternatively, when the partition 279A is formed at the plate 250, the partition 279A may extend forward toward the cover 270 from the plate 250.

In embodiments as broadly described herein, since the air outside the cavity 210 may be additionally supplied to the burner chamber C through the air inlet 214, generation of carbon monoxide due to the incomplete burning of the mixed gas may be decreased.

In this embodiment, since the contact portion 275 of the cover 270 contacts the bottom wall 212 of the cavity 210, the air inlet 214 is not exposed outside while the oven door 220 is opened. Further, the contact portion 275 of the cover 270 is positioned at the front of the air inlet 214, that is, between the air inlet 214 and the recessed portion 213, and thus it may be possible to prevent food and the like from flowing into the air inlet 214 during cooking or cleaning of the cavity 210.

Hereinafter, operation of the burner assembly will be described.

When the burner assembly is turned on, the mixed gas is supplied to the burner 240 to generate flames in the burner 240. In addition, when the fan motor 280 is turned on, the fan 260 rotates. As the fan 260 rotates, the air A3 in the cooking chamber 211 flows into the burner chamber C through the inlet 273 formed in the cover 270. The air flowing into the burner chamber C is guided by the partitions 254 and 254A into the air passage P through the opening 255 in the plate 250. In order to minimize the influence of the air A3 on the flames generated by the burner 240, the partitions 254 and 254A may contact the cover 270.

Since the burner chamber C and the air passage P are heated by the flames of the burner 240, the air flowing to the air passage P is heated as the air flows. In addition, the air A4 flows from the air passage P through the communicating opening(s) 256 of the plate 250, and then is discharged to the cooking chamber 211 through the side outlet(s) 277 and the lower outlet(s) 279 of the cover 270. The remainder of the air in the air passage P may be directly discharged to the cooking chamber 211 through the upper outlet(s) 278 of the cover 270.

In the above embodiment, the burner assembly is installed on the rear wall of the cavity, within the cavity. However, in alternative embodiments, the burner assembly may be installed on the rear wall of the cavity, outside the cavity.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

Embodiments as broadly described herein are directed to a gas oven range.

In one embodiment, a gas oven range as broadly described herein may include a cavity to form a cooking chamber in which foods are cooked; and a burner assembly installed on a rear wall of the cavity, in which the burner assembly includes a burner having flame holes, a plate to support the burner, and a cover member to cover the burner to form a burner chamber and having an inlet flowing air of the cooking chamber into the burner chamber, and a partition to partitions air flowing from the cooking chamber to the burner chamber and flames generated from the burner and provided between the cover member and the plate.

In another embodiment, a gas oven range as broadly described herein may include a cavity to form a cooking chamber in which foods are cooked; a cover member installed on one wall of the cavity in the cavity and having an inlet into which air in the cooking chamber flows; a burner disposed between one wall of the cover member and the cover member and having a plurality of flame holes; a plate disposed between one wall of the cover member and the cover member to support the burner; and a partition provided between the cover member and the plate to partition air flowing through the inlet from the cooking chamber and flames generated from the burner.

Any reference in this specification to "one embodiment," "an embodiment," "example embodiment," etc., means that a particular feature, structure, or characteristic described in connection with the embodiment is included in at least one embodiment of the invention. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A gas cooking apparatus, comprising;
a cavity forming a cooking chamber; and
a burner assembly installed on a rear wall of the cavity, wherein the burner assembly includes:
a plate;
a burner installed on the plate and having a plurality of flame holes;
a cover to cover the burner, wherein the cover defines a burner chamber together with the plate, the burner being enclosed within the burner chamber; and
an inlet provided at the cover to guide air from the cooking chamber into the burner chamber; and
a partition provided between the cover and the plate to isolate air flowing from the cooking chamber into the burner chamber from flames generated by the burner, wherein the partition extends from one of the cover or the plate to the other of the cover or the plate, wherein the burner includes:
a burner body including a U-shaped tube; and
a supply duct coupled to the burner body to supply a gas-air mixture to the burner body, and wherein the partition includes:
a first partition having a U-shape corresponding to a shape of the U-shaped tube; and
a second partition that connects two opposite ends of the first partition.

2. The apparatus of claim 1, wherein the supply duct is coupled to a lower central portion of the U-shaped tube, and wherein the plurality of flame holes is formed in an outer peripheral surface of the U-shaped tube and an inner peripheral surface of the U-shaped tube confronts the partition.

3. The apparatus of claim 1, wherein the plate has an opening formed therein, and the first partition is provided along a periphery of the opening, and wherein the first and second partitions guide air from the inlet formed in the cover through the opening.

4. The apparatus of claim 1, wherein a first peripheral surface of the burner body faces the partition, and the plurality of flame holes is formed in a second peripheral surface of the burner body facing away from the partition.

5. The apparatus of claim 1, wherein the burner body at least partially surrounds the partition, with the first peripheral surface of the burner body facing a central portion of the burner assembly, and the second peripheral surface of the burner body facing away from the central portion of the burner assembly.

6. The apparatus of claim 1, wherein the burner is positioned around the first partition, and wherein the first and second partitions extend between the plate and the cover so as to enclose the burner within the burner chamber and isolate the burner from air flowing through the inlet in the cover and the opening in the plate.

7. The apparatus of claim 1, wherein the burner body includes one or more protrusions, and the plate includes one or more second holes configured to respectively receive the one or more protrusions of the burner body so as to couple the burner body to the plate.

8. The apparatus of claim 1, wherein the plate further includes a fastening portion to fasten the plate to the rear wall of the cavity and to maintain a predetermined distance between the plate and the rear wall of the cavity.

9. The apparatus of claim 8, wherein the fastening portion includes:
a first extension that extends in a horizontal direction from the plate; and
a second extension that extends in a vertical direction from the first extension, the second extension including a fastening hole that receives a fastener therethrough.

10. The apparatus of claim 8, wherein the plate has at least one communicating opening formed therein to provide for communication between a space formed between the plate and the rear wall of the cavity and a space formed between the plate and the cover.

11. The apparatus of claim 10, wherein the cover includes at least one outlet corresponding to the at least one communicating opening formed in the plate, wherein air flowing through the at least one communicating opening is discharged into the cavity through the at least one outlet formed in the cover.

12. The apparatus of claim 1, wherein a lower end of the cover and a lower end of the plate contact the bottom wall of the cavity such that the cover, the plate and a portion of the bottom wall define the burner chamber.

13. A gas cooking apparatus, comprising:
a cavity that defines a cooking chamber;
a cover installed on one interior wall surface of the cavity, the cover having an inlet through which air from the cooking chamber flows;
a plate positioned between the one interior wall surface of the cavity and the cover;
a burner installed on the plate and positioned between the plate and the cover, the burner having a plurality of flame holes; and
a partition provided between the cover and the plate to isolate air flowing from the cooking chamber through the inlet from flames generated by the burner, wherein the burner includes:
a burner body including a U-shaped tube; and a supply duct coupled to the burner body to supply a gas-air mixture to the burner body, wherein the partition includes:

a first partition having a U-shape corresponding to a shape of the U-shaped tube; and a second partition that connects two opposite ends of the first partition.

14. The apparatus of claim 13, wherein the plate includes an opening that guides air from the inlet therethrough, wherein the partition partitions the opening from the burner.

15. The apparatus of claim 13, wherein the partition is formed at one of the cover or the plate and extends to the other of the cover or the plate.

16. The apparatus of claim 13, wherein the burner includes a first peripheral surface facing the partition and a second peripheral surface facing away from the partition, and wherein the plurality or flame holes is formed in the second peripheral surface.

* * * * *